US006880458B2

(12) United States Patent
Munz et al.

(10) Patent No.: US 6,880,458 B2
(45) Date of Patent: Apr. 19, 2005

(54) PROCESS AND DEVICE FOR DETERMINING THE POSITION AND/OR THE SHAPE OF MARKS ON PRINTED-ON PAPER WEBS

(75) Inventors: Curt Munz, Konolfingen (CH); Jean-Claude Mengisen, Schönbühl (CH)

(73) Assignee: Maschinenfabrik WIFAG, Bern (CH)

( * ) Notice: Subject to any disclaimer, the term of this patent is extended or adjusted under 35 U.S.C. 154(b) by 0 days.

(21) Appl. No.: 10/650,290

(22) Filed: Aug. 28, 2003

(65) Prior Publication Data

US 2004/0055491 A1 Mar. 25, 2004

(30) Foreign Application Priority Data

Sep. 24, 2002 (DE) ..... 102 44 437

(51) Int. Cl.[7] ..... B41M 1/14
(52) U.S. Cl. ..... 101/211; 101/181; 101/485
(58) Field of Search ..... 101/181, 211, 101/219, 228, 484, 485, 486, DIG. 36

(56) References Cited

U.S. PATENT DOCUMENTS

| | | | | |
|---|---|---|---|---|
| 5,138,667 A | * | 8/1992 | Roch et al. | 382/112 |
| 5,444,525 A | * | 8/1995 | Takahashi et al. | 399/76 |
| 5,613,261 A | * | 3/1997 | Kawakami et al. | 15/98 |
| 5,625,758 A | | 4/1997 | Schneider et al. | |
| 6,050,192 A | | 4/2000 | Kipphan et al. | |

FOREIGN PATENT DOCUMENTS

| | | |
|---|---|---|
| DE | 43 21 179 | 1/1995 |
| DE | 43 28 026 | 3/1995 |

* cited by examiner

*Primary Examiner*—Ren Yan
(74) *Attorney, Agent, or Firm*—McGlew and Tuttle, P.C.

(57) ABSTRACT

A process and device are provided for determining the position and/or the shape of at least one mark on a web to be printed on. The position and/or the shape of the at least one mark in the image to be printed is determined with the use of prepress data. The device for determining the position and/or the shape of at least one mark on a web to be printed on includes an input device for entering prepress data and a device for determining position data and/or shapes for a mark based on the prepress data entered.

21 Claims, 3 Drawing Sheets

PROCESS AND DEVICE FOR DETERMINING THE POSITION AND/OR THE SHAPE OF MARKS ON PRINTED-ON PAPER WEBS

FIELD OF THE INVENTION

The present invention pertains to a process and a device for determining the position and/or the shape of marks on a printed-on paper web.

BACKGROUND OF THE INVENTION

Various printed products, e.g., newspapers, are usually printed according to the rotary offset process. Paper webs are unwound here from rolls and printed on in a plurality of printing couples, partly in multiple colors. The ink to be printed may be metered, e.g., by means of ink screws. The ink register mark indicates the relative positions of various ink layers applied in relation to one another. Even very small deviations of the ink register mark by, e.g., 0.01 mm are perceived by the eye and are found to be disturbing. The register mark deviation provides information on the extent of the position deviations of different ink layers, which together form a printed page of a newspaper. Such register mark deviations may occur along or at right angles to the direction of run of the paper. Deviations at right angles to the direction of run of the paper are usually corrected with the side register, and deviations in the direction of run of the paper web are corrected with the circumferential or ink register.

The ink register mark is affected, e.g., by the distance between the printing mechanisms, the properties of the paper, the water used during the printing, the ink, the roll change, the pull on the paper web or the speed of printing, and ink register controllers are used to correct deviations of the ink register mark.

It is known that marks may be printed on the paper web corresponding to the inks used, and the ink register mark can be determined from the marks printed on. These marks are printed on permanently predetermined areas of the paper web and are shown as an example in FIG. 1. A plurality of marks may be printed in a mark field 1. It is necessary now for the reliable determination of the position of the mark to provide a white area around a mark field 1. If, e.g., marks are placed too close to printed-on areas, it is possible that a sensor will no longer be able to reliably recognize the marks and thus to determine the ink register mark.

Marks and mark fields are defined for each ink register controller product. It can be assumed that the marks are placed during the manufacture of the plates in the predetermined position and in the desired size, and the needed white space was taken into account.

Since mark fields are always arranged at the same site, e.g., laterally at the edge of the plate outside the printing area, handling is simple during the manufacture of the plate. A sensor used to detect the mark fields needs only be set to the predetermined discrete positions in printing mechanisms of different widths in order to reliably detect the mark fields.

If marks are printed at a great distance next to color images, as is shown in FIG. 1, the presetting system calculates no ink removal, e.g., on the basis of the marks placed outside the printing area or, e.g., on the basis of a small mark area for the ink screw zones of the marks. If the printer does not open the ink screws in this case, the marks will not be printed. The controller cannot thus assume its function.

A process for controlling the operations of a printing press, in which coordinates of measuring points are determined for an image recording means from image information that reflects at least the surface of a printed product, the image recording means detecting at each measuring point a measuring field of a defined size on the surface of a printed product, has become known from WO 95/00336 A2.

SUMMARY OF THE INVENTION

The object of the present invention is to propose a process and a device especially for the offset printing of newspapers which make it possible to check the quality of a printed-on web in a simple and reliable manner.

Marks or mark fields are arranged according to the present invention in the printing format itself, and to determine the shape and/or the position of marks on a printed-on web, e.g., on a printed-on paper web in a printing press, e.g., a web-fed printing press for printing newspapers, the position and/or the shape of at least one mark on the web to be printed on is obtained from digital or analog prepress image data or the print originals. The use of these prepress data makes possible the determination, e.g., the automatic determination of one or more suitable positions and/or shapes of marks, e.g., register marks, in an image to be printed. A suitable or advantageous position and/or shape of one or more marks or of one or more mark fields in an image can now be determined in both the horizontal direction and the vertical direction. For example, it is possible to seek an image area that can already be used as a measuring area for an ink and/or register control, e.g., an area that contains many pieces of or significant color information or crossed structures without the additional insertion of a mark. Likewise, it is possible to seek, e.g., an image area in which marks or mark fields of a shape fitting the image can be inserted at a position fitting into the image without the overall impression of the image being disturbed by the inserted mark.

Using prepress data, it is possible to determine the exact position of the register marks in both the horizontal direction and the vertical direction.

Depending on the prepress data format, it is possible to define the marks directly as objects in the layout. For example, Postscript makes it possible to name objects. Examples of such objects are marks, mark field and white space. The number, size and position of the marks, the mark field and the white space can be determined in this manner.

The marks can thus be determined, e.g., directly as objects in the layout, i.e., prior to the printing operation proper. Furthermore, it is also possible to define as objects, e.g., a mark field and a white area or white space necessary around the mark field, so that, e.g., the number, size, shape and/or position of the marks, mark fields and of the white space or white area are defined in the layout using the prepress data prior to the printing operation proper, so that the marks, mark fields and white areas are generated during the printing together with the printing format proper and it is no longer necessary to additionally provide mark fields at the edge of the plate outside the printing area. However, it is possible to use such prior-art mark fields combined with the marks or mark fields inserted according to the present invention into a printing format with the use of prepress data.

The position and/or shape of at least one mark, of a mark field and/or of the white area located around a mark or mark field can be determined, e.g., from the data of the raster image processor (RIP) or another source for prepress data for each printing plate. Likewise, the position of a mark or of a mark field in relation to another mark or mark field, the shape of a mark or of a mark field can also be determined and/or checked, besides the location or position of a mark or of a mark field in a printing format or on a printing plate, so that, e.g., a mark field can be inserted well into a pattern to be printed, and the minimum and/or maximum extension of the mark field and/or the white area around the mark or the mark field can be determined and/or checked. If the mark or the mark field does not meet certain preset criteria, it is possible to search for other positions for the mark or the mark field in an additional step before the printing process, for which an automatic algorithm is advantageously provided, which suggests or even automatically selects one or more positions for a mark and/or a mark field. If, e.g., no suitable mark field can be found because of production data, e.g., the ink and plate coverage or because of other preset data, which are entered, e.g., externally, it is possible to send automatically a corresponding error message.

The mark field and/or mark coordinates or positions may be advantageously used to check the quality of the printed product, especially to position one or more sensors for detecting the printed marks or mark fields. The so-called horizontal mark field position, i.e., the position of the marks forming the mark field, or of a mark at right angles to the direction of run of the paper web can be checked by the suitable positioning of one or more sensors. The vertical mark field position, i.e., the position of a mark or of a mark field in the direction of run of a printed web, is determined by recording an image by a sensor at a certain point in time. The image recording is advantageously synchronized, and the position data of the marks inserted according to the present invention may also be used for the synchronization, so that the vertical position of a mark or of a mark field and hence the reference position of the ink register mark and good register can be determined from the image recorded at a certain point in time. The assignment of the individual marks to the final control elements and sensors or sensor positioning elements can also be performed automatically by means of prepress data and with the use of production data, e.g., from the production planning computer. Production data may be, e.g., web guiding, plate and/or ink coverage.

The shapes and/or positions of one or more marks in a printing format, which are determined according to the present invention with the use of prepress data, may be selected extensively freely depending on the content of the image to be printed and the colorfulness. Thus, it is possible, but no longer necessary, for marks to be arranged at the edge of the page outside the printing area. For example, a mark or a mark field may be placed according to the present invention such that the same ink screws can be used for a color image to be printed as for printing the marks or the mark field. If the marks are placed in the vicinity of a color image, they can reflect the ink register mark better, i.e., a mark or a mark field located in the vicinity of the color image provides information with greater accuracy concerning the ink register mark that is relevant for the image than does a mark arranged at a greater distance from a color image, because errors that may occur may have a greater effect because of the distance in space and/or time. Thus, marks and/or mark fields are advantageously positioned in the vicinity of images to be printed.

It is possible, in general, to define a plurality of mark fields, and, e.g., a general fixed position at the edge of the page and at least one image-dependent mark field can be defined, so that it is possible at any time to switch over to the fixed general marks during the image detection if the detection of an image-dependent mark is not possible.

Criteria are advantageously preset concerning the arrangement of marks or mark fields, e.g., the white space and the maximum extension of a mark field, and taking these criteria into account, a mark or a mark field and a mark arrangement can be adapted to the conditions of an image in order to arrange a mark or a mark field of a shape advantageous for the image and/or the mark recognition in an image-dependent manner in a place advantageous for the image. In general, marks or mark fields may be arranged as desired, e.g., next to one another or in a semicircle, but it should be ensured that the distances between the marks which are needed for the reliable detection of marks or mark fields are maintained.

The mark coordinates of the prepress data are used for the determination of the reference position of the individual marks. The reference position describes the desired position of the mark on the printed-on paper web, at which a certain register error is expected.

For example, a mark can be preferably automatically assigned to each color by means of the prepress data or a color can be preferably automatically assigned to each mark in order to precisely determine the correct position or the register deviation of a certain ink. For example, a mark for checking the correct position of blue image components may be arranged in the vicinity of a larger blue area, while a mark for checking, e.g., the correct position of red image components may be arranged in the vicinity of a larger red image pattern, if present. Thus, marks or mark fields may be arranged according to the present invention at advantageous positions, which are also located distributed over a printing format, while so-called color measuring fields were previously printed at fixed positions, as a result of which the available printable area was reduced.

Due to the process according to the present invention, the position of one or more marks or mark fields no longer depends on the printing mechanism, so that no changeovers related to the printing mechanism are necessary when the order of colors is changed in the printing mechanisms of a printing press.

The degree of soiling of a lens or of a camera or a change in illumination can be advantageously recognized by comparing the prepress data with the images detected by a sensor, e.g., a camera or a CCD element and also adjusted and corrected if necessary in order to ensure the continuous reliable recognition of marks.

According to another aspect, the present invention pertains to a device for determining and/or setting the shape and/or the position of at least one mark or of a mark field in an image to be printed with the use of prepress data. The device is advantageously designed such that at least one of the above-described process steps can be carried out.

The determination of the position of the mark according to the present invention by upstream systems or the prepress data makes it possible to transmit the position of marks or mark fields directly to controllers, such as a circumferential register controller.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
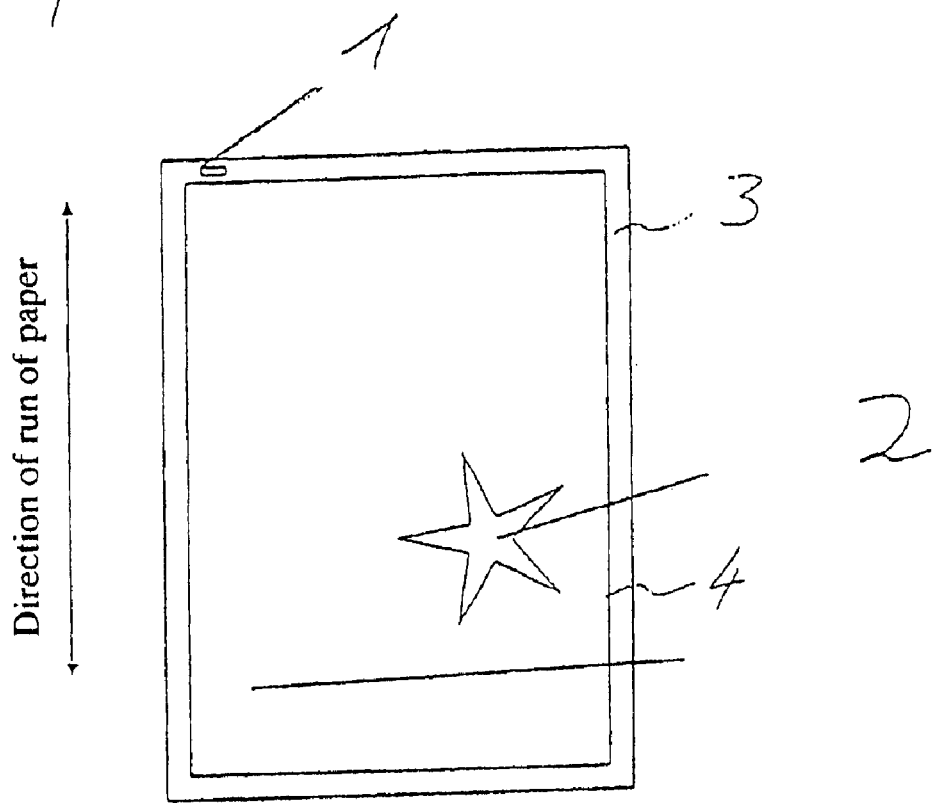
FIG. 1 is a view showing the arrangement of a mark field according to the state of the art.
Figure 2:
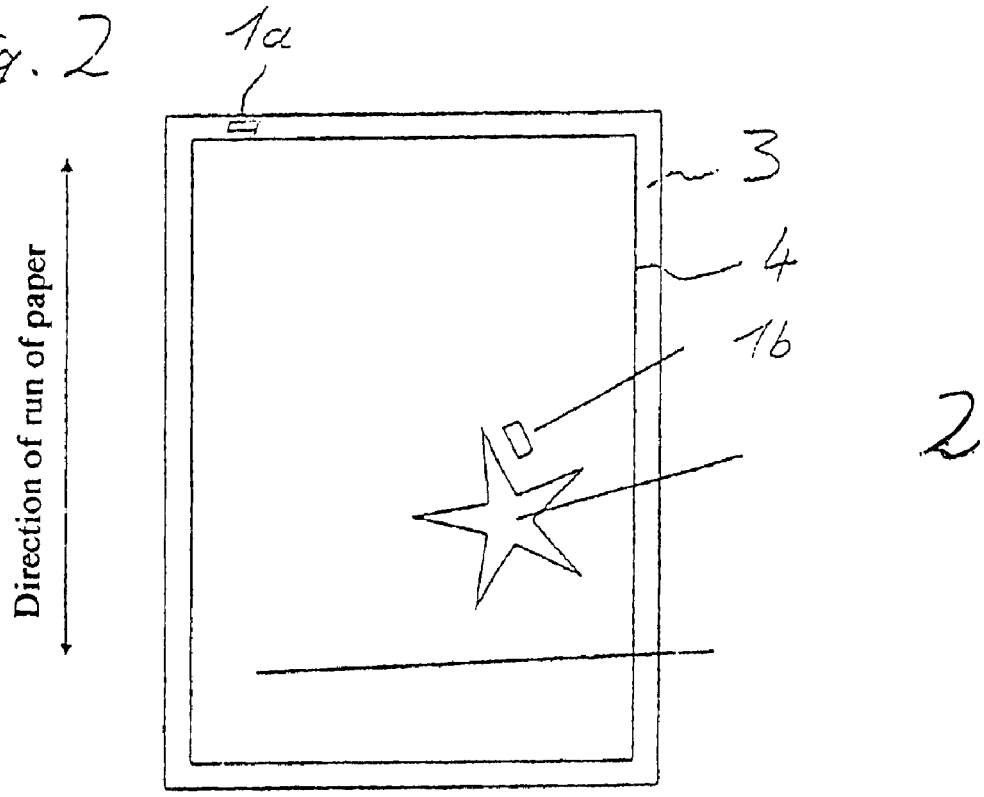
FIG. 2 is a view showing the arrangement of a mark field according to the present invention.

Referring to the drawings in particular, FIG. 2 shows an example of an image to be printed, wherein a mark field 1*a* is arranged at a fixed position at the edge 3 of the plate outside the printing area 4. Using prepress data, from which the shape and the position of the colored pattern 2 can be obtained, a mark field 1*b* of a shape not disturbing the viewer as to the view of the pattern 2, is arranged according to the present invention in the vicinity of the colored pattern 2. The arrangement is made in order to make it possible to measure register deviations of the colored pattern 2 as accurately as possible.

Figure 3:
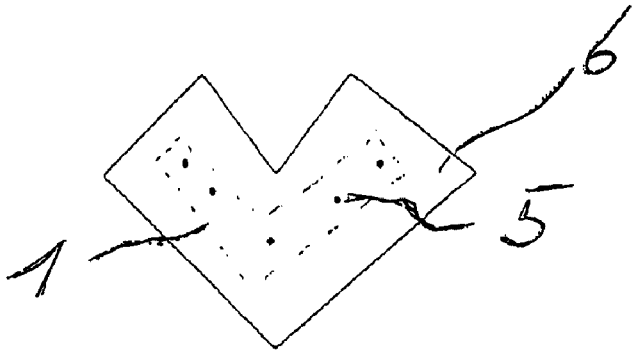
FIG. 3 is a view showing an exemplary mark field.
Figure 4:
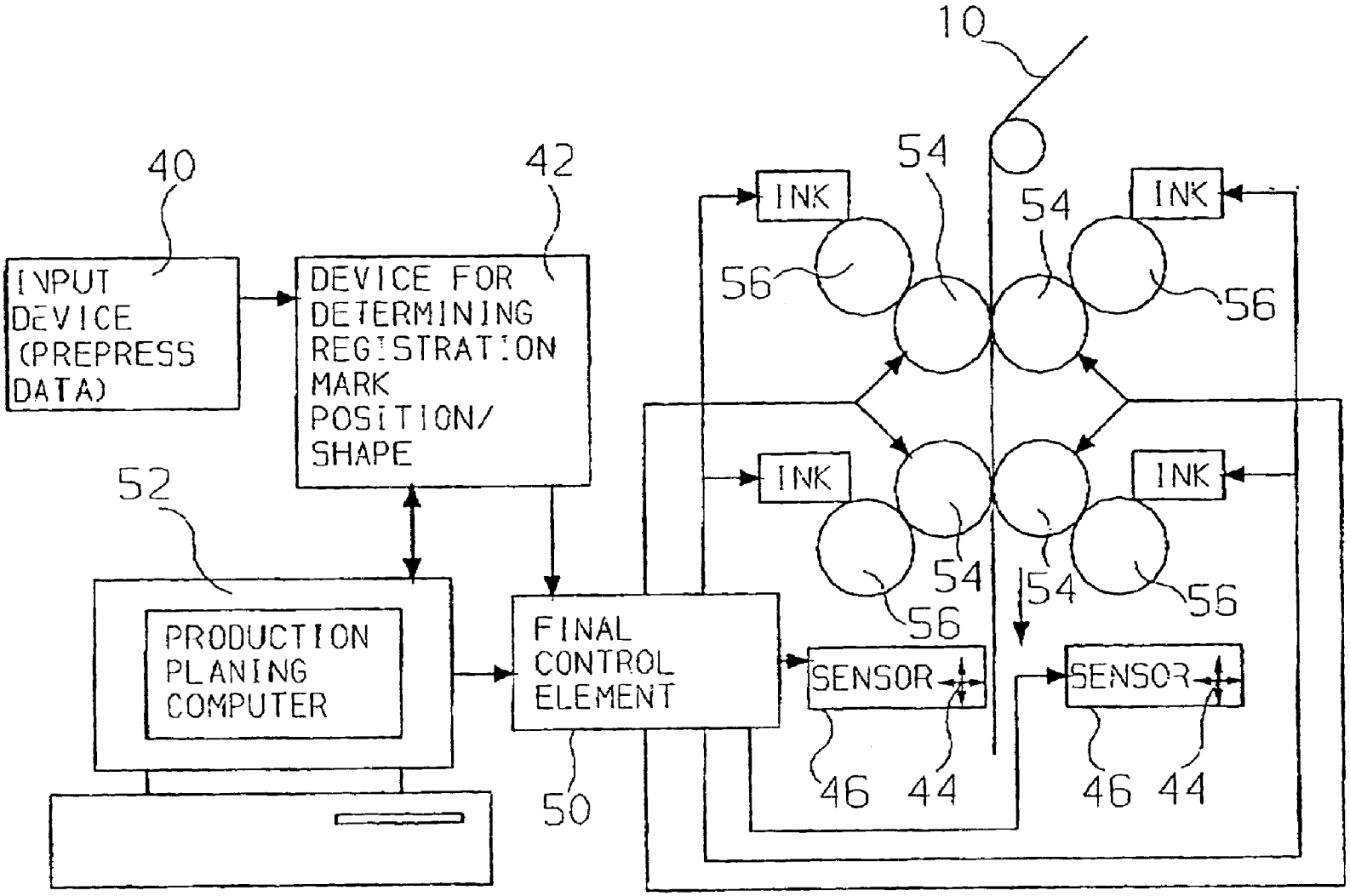
FIG. 4 is a schematic diagram showing aspects of the process and device of the invention.

FIG. 3 shows an exemplary embodiment of a plurality of individual marks 5 in a mark field 1, wherein the individual marks 5 have a preset minimum distance from each other in order to ensure the reliable detection of an individual mark 5. The white space or white area 6, which is arranged around the mark field 1 indicated by a broken line and which is defined by the solid line, ensures that the individual marks 5 can be detected precisely and the detection of the position of the marks 5 is not affected by surrounding patterns.

The invention provides a process for determining the position and/or the shape of at least one mark on a web to be printed on. The process includes determining a position and/or the shape of the at least one mark in the image to be printed with the use of prepress data provided form input 40. The prepress data includes information as to the layout of the print including graphics information and color information. The position and/or the shape of a plurality of marks and/or at least one mark field and/or at least one mark field white edge is determined with the use of this prepress data at 42.

The position data of the at least one mark or of the mark field may then be used to provide the position 44 for the at least one sensor 46. The position of at least one mark 5 and/or of a mark field 1 may also be used to determine the point in time of the detection of the mark by at least one sensor 46. The detected position of at least one mark 5 and/or of a mark field 1 may then be used to determine the reference position.

The process may be employed such that position errors of at least one mark 5 and/or of a mark field 1 and/or of the white edge 6 are determined. A degree of soiling of the sensor(s) 46 and/or the intensity of illumination may be determined from a comparison of the prepress data with the data detected by sensor(s) 46.

An unambiguous assignment can be established between marks 5 and final control elements 50 from the production data and the mark coordinates determined. The production data may be obtained from a production planning computer 52. Production data may be, e.g., plate and/or ink coverage 56; 54, or reference values to register adjustment of impression cylinder.

The device according to the invention is used for determining the position and/or the shape of at least one mark 5 on a web 10 to be printed on. The device includes the input device 40 for entering prepress data and a device 42 for determining position data and/or shapes for a mark 5 based on the prepress data entered. A device for checking the print quality may be provided with the determination device 42 and with the at least one sensor 46, which is positioned and/or actuated at 44 on the basis of position data determined.

While a specific embodiment of the invention has been shown and described in detail to illustrate the application of the principles of the invention, it will be understood that the invention may be embodied otherwise without departing from such principles.

What is claimed is:

1. A process for determining the position and the shape of at least one registration mark on a web to be printed on, the process comprising:

obtaining the image to be printed including obtaining prepress data of the image to be printed from digital or analog image data of a preliminary printing stage or a print original;

establishing predetermined criteria for arranging the registration mark;

adapting the criteria to the conditions of the image to be printed based on the prepress data;

determining the position and the shape of at least one registration mark in the image to be printed using the prepress data in which the position of the mark in the actual print image is arranged randomly in regions of the print image established based on the criteria adapted to the conditions of the image to be printed.

2. A process in accordance with claim 1, wherein the position and/or the shape of a plurality of marks and/or at least one mark field and/or at least one mark field white edge is determined with the use of the prepress data.

3. A process in accordance with claim 1, further comprising:

providing at least one sensor; and forming registration mark position data based on the determined position and shape of the registration mark, wherein the position data of the at least one mark or of the mark field are used to position the at least one sensor.

4. A process in accordance with claim 1, further comprising:

providing at least one sensor;

forming registration mark position data based on the determined position and shape of the registration mark; and determining a point in time for registration mark detection using the sensor, wherein the position data of the at least one registration mark and/or of a mark field is used to determine the point in time of the detection of the mark by the at least one sensor.

5. A process in accordance with claim 1, wherein the detected position of at least one mark and/or of a mark field is used to determine a reference position.

6. A process in accordance with claim 1, further comprising:

providing one or more sensors;

forming registration mark position data based on the determined position and shape of the at least one registration mark and/or a mark field of registration marks;

positioning the sensor and/or determining a point in time for registration mark detection using the sensor based on the position data of the registration; and using the one or more sensors to form data to determine position errors of the at least one registration mark and/or of a mark field and/or of the white edge.

7. A process in accordance with claim 6, further comprising determining the degree of soiling of the sensors and/or the intensity of illumination from a comparison of the prepress data with the data detected by sensors.

8. A process in accordance with claim 1, further comprising:

establishing an unambiguous assignment between the registration marks and final control elements controlling ink for the print production using production data from a production planning computer.

9. A process in accordance with claim 8, wherein the production data includes one or more of web guiding data, plate coverage data and/or ink coverage data.

10. A device for determining the position and/or the shape of at least one mark on a web to be printed on, the device comprising:

an input device for entering prepress data of the image to be printed from digital or analog image data of a preliminary printing stage or a print original; and a device for determining position data and shapes for a registration mark based on the prepress data entered, the device having predetermined criteria for arranging the registration mark adapted to the conditions of the image to be printed based on the prepress data and wherein the position of the mark in the actual print image is arranged randomly in regions of the print image established based on the criteria adapted to the conditions of the image to be printed.

11. A device according to claim 10, wherein the device further is for checking the print quality with at least one sensor, the device further comprising:

a sensor positioned and/or actuated on the basis of position data determined.

12. A device in accordance with claim 11, wherein the position and the shape of a plurality of marks and at least one mark field and at least one mark field white edge is determined with the use of the prepress data.

13. A device in accordance with claim 12, further comprising:

a final control element, wherein said final control element uses said position data to position said sensor or time the activation of said sensor.

14. A device in accordance with claim 13, wherein the device for determining position data and shapes for a registration mark uses the detected position of at least one registration mark and/or of a mark field to determine a reference position.

15. A device in accordance with claim 14, wherein the device for determining position data and shapes for a registration mark determines position data a mark field and/or a white edge of the registration mark or mark field.

16. A device in accordance with claim 13, wherein one of the device for determining position data and shapes for a registration mark and the final control element determines the degree of soiling of the sensors and/or the intensity of illumination from a comparison of the prepress data with the data detected by the sensor.

17. A device in accordance with claim 11, wherein one of the device for determining position data and shapes for a registration mark and the final control element establishes an unambiguous assignment between the registration marks and the control of the ink for the print production using production data from a production planning computer.

18. A device in accordance with claim 17, wherein the production data includes one or more of web guiding data, plate coverage data and/or ink coverage data.

19. A device for control of printing on a web, the device comprising:

an input device for entering the prepress data of the image to be printed from digital or analog image data of a preliminary printing stage or a print original; and a registration mark position and shape determination means for determining position and shape data for a registration mark based on the prepress data entered, the device having predetermined criteria for arranging the registration mark adapted to the conditions of the image to be printed based on the prepress data and wherein the position of the mark in the actual print image is arranged randomly in regions of the print image, said regions being established based on the criteria adapted to the conditions of the image to be printed;

a web printing station with a plurality of inking rollers and ink feed mechanisms;

a production planning computer providing one or more of web guiding data, plate coverage data and/or ink coverage data;

a final control element connected to said mark position and shape determination means, connected to said web printing station and connected to said production planning computer for controlling said web printing station based on said production planning computer and based on said position and shape data for a registration mark;

a sensor; said sensor being positioned and/or actuated by said final control element on the basis of position and shape data.

20. A device in accordance with claim 19, wherein one of the device for determining position data and shapes for a registration mark and the final control element determines the degree of soiling of the sensors and/or the intensity of illumination from a comparison of the prepress data with the data detected by the sensor.

21. A device in accordance with claim 19, wherein one of the device for determining position data and shapes for a registration mark and the final control element establishes an unambiguous assignment between the registration mark sensed by said sensor and the control of the ink for the print production using production data from a production planning computer.

* * * * *